US007386953B2

(12) United States Patent
Ball

(10) Patent No.: US 7,386,953 B2
(45) Date of Patent: Jun. 17, 2008

(54) SIGHTING DEVICE WITH MULTIFUNCTION ILLUMINATED RETICLE STRUCTURE

(75) Inventor: Roger Willard Ball, Penetang (CA)

(73) Assignee: Raytheon Company, Waltham, MA (US)

( * ) Notice: Subject to any disclaimer, the term of this patent is extended or adjusted under 35 U.S.C. 154(b) by 371 days.

(21) Appl. No.: 10/996,728

(22) Filed: Nov. 24, 2004

(65) Prior Publication Data

US 2006/0107581 A1 May 25, 2006

(51) Int. Cl.
*F41G 1/12* (2006.01)

(52) U.S. Cl. ..... 42/123; 42/113; 42/131

(58) Field of Classification Search ..... 42/113, 42/122, 123, 130, 131, 144, 145
See application file for complete search history.

(56) References Cited

U.S. PATENT DOCUMENTS 2,377,064 A * 5/1945 Aufiero ..... 356/254
3,515,480 A * 6/1970 Altman et al. ..... 356/5.01
3,672,782 A 6/1972 Akin, Jr.
4,507,874 A 4/1985 Brown
4,749,271 A 6/1988 Nagler
4,792,673 A * 12/1988 Blackler ..... 250/214 VT
5,414,557 A 5/1995 Phillips
5,901,452 A 5/1999 Clarkson
7,269,920 B2 * 9/2007 Staley, III ..... 42/114
2002/0078618 A1 * 6/2002 Gaber ..... 42/123

* cited by examiner

*Primary Examiner*—Stephen M Johnson
(74) *Attorney, Agent, or Firm*—H. St. Julian

(57) ABSTRACT

A sighting device is used to aim along a line of sight at a target. The sighting device includes a reticle structure formed of a roof prism assembly having an inclined final roof-prism mirror surface that is not perpendicular to the line of sight. The inclined final roof-prism mirror surface is the last surface of the roof prism assembly from which an optical path of the target reflects before leaving the roof prism assembly. There are two sets of sighting reference features, wherein the sets of sighting reference features are disposed on the inclined roof-prism mirror surface. A separately operable illumination source is provided for each of the sets of sighting reference features, wherein each illumination source illuminates only one set of sighting reference features.

9 Claims, 3 Drawing Sheets

SIGHTING DEVICE WITH MULTIFUNCTION ILLUMINATED RETICLE STRUCTURE

This invention relates to sighting and, more particularly, to a sighting device used to aim a weapon, aim an observation telescope, or in other applications.

BACKGROUND OF THE INVENTION

A hand-held weapon such as a rifle, pistol, or directed-energy device is aimed by pointing the barrel of the weapon at a target. To aid in the pointing, a sight is usually provided. "Iron" sights utilize fixed mechanical structure on the top of the barrel to aid in aligning the barrel toward the target. Laser sights project a laser beam that is placed on the target to aim the weapon. Telescopic sights use optics to view the image of the target, and typically enlarge the image of the target. The present approach is concerned with such telescopic sights.

The telescopic sight includes a sighting reference feature such as a cross hair. The sighting reference feature allows the visual sighting by the user of the weapon to be brought into correspondence with the impact point of the projectile. During the calibration of the sight, the position of the sighting reference feature is adjusted to achieve a correspondence between the aiming point of the sighting reference feature and the impact point of the projectile. In telescopic sights that are to be used in reduced-light applications, the sighting reference feature is typically illuminated so that it may be clearly viewed against the primarily reduced-light field seen through the sight.

Experience has shown that different types of sighting reference features are most advantageously used in particular situations. For example, for short-range, rapid-fire aiming, typically where the target is at a distance of less than about 200 meters, a single dot (traditionally a red dot) sighting reference feature gives the best results because of its simplicity and quick target acquisition, and because the user is not distracted by any reference feature other than the single dot. For longer-range, lower-firing-rate aiming, typically where the target is at a distance of more than about 200 meters and more-precise aiming is required, a sighting reference feature such as a cross hair with ranging lines gives greater accuracy, because the user can more readily take into account the drop of the projectile over the greater distance and also windage effects. In this long-range situation, the single dot used for close-in aiming is a distraction, and in a short-range situation the cross hair is a distraction.

A weapon that is to be used in both shorter-range and longer-range applications, and in both daylight and reduced-light applications, would desirably include two or more types of sighting reference features. The type of sighting reference feature would be selectively visible to the user of the weapon. There is a need for such a sighting device, which is not currently available. The present invention fulfills this need, and further provides related advantages.

SUMMARY OF THE INVENTION

The present invention provides a sighting device that permits the user to select between two or more sets of sighting reference features for various applications. The sighting reference features are illuminated to permit both daylight and low-light use. Only one set of the sighting reference features are illuminated and visible at any moment. The present approach is compatible with other sighting features, such as a telescopic objective lens. The application of most current interest is with projectile weapons, but it may be used with other weapons and with other devices as well, such as other types of observation devices.

In accordance with the invention, a sighting device for aiming along a line of sight at a target comprises a reticle structure having at least two sets of sighting reference features, and separately operable illumination sources for each of the sets of sighting reference features. Each illumination source illuminates only its designated set of sighting reference features. The sighting reference features may be of any operable type, but in a preferred embodiment, a first set of sighting reference features comprises a set of lines, and a second set of sighting reference features a single dot. There is desirably a switch operable to alternatively operate one of the illumination sources at a time. The sighting device usually includes additional optical components such as an objective lens, which may be a telescopic lens, and an eyepiece.

The reticle structure preferably comprises a sighting-feature surface region, with the sets of sighting reference features disposed at the sighting-feature surface region. In one embodiment, the sets of sighting reference features are disposed at a single sighting-feature surface region of the reticle structure. An optical path may reflect from the single sighting-feature surface region as the optical path passes through the reticle structure. The reticle structure may comprise a transparent-medium surface, wherein a first set of sighting reference features is disposed on the transparent-medium surface, and a metallic layer contacting the transparent-medium surface, wherein the second set of sighting reference features is disposed in the metallic layer. The first set of sighting reference features and the second set of sighting reference features are desirably optically aligned and in optical registry with each other, and aligned with the line of sight, when viewed by the user of the sighting device.

The sighting-feature surface region is preferably angularly inclined to the line of sight, wherein the sets of sighting reference features are disposed at the sighting-feature surface region. There may be a mirror structure that redirects an image of the target initially on the line of sight to be off the line of sight, reflects the image of the target off the sighting-feature surface region, and redirects the target image back to the line of sight.

The separately operable illumination source for each of the sets of sighting reference features may comprise a first light-emitting diode for the first set of sighting reference features, and a second light-emitting diode for the second set of sighting reference features.

The reticle structure may be conveniently structured to include a roof prism assembly having at least two inclined roof-prism surfaces that are not perpendicular to the line of sight, and at least two sets of sighting reference features. In one embodiment, a first set of sighting reference features comprises a set of lines, and a second set of sighting reference features comprises a single dot. At least one of the sets of sighting reference features is disposed on one of the inclined roof-prism surfaces. Preferably, all of the sets of sighting reference features are disposed on the same inclined roof-prism surface. There is a selectively operable illumination source for each of the sets of sighting reference features. Each illumination source illuminates only its designated set of sighting reference features. There is typically an objective lens disposed between the target and the reticle structure. Other compatible features discussed herein may be used with this embodiment.

A sighting device for aiming along a line of sight at a target comprises a reticle structure comprising a roof prism assembly having an inclined final roof-prism mirror surface that is not perpendicular to the line of sight. The inclined final roof-prism mirror surface is the last surface of the roof prism assembly from which an optical path of the target reflects before leaving the roof prism assembly. There are two sets of sighting reference features, wherein the sets of sighting reference features are disposed on the inclined roof-prism mirror surface. A separately operable illumination source is provided for each of the sets of sighting reference features, wherein each illumination source illuminates only one set of sighting reference features. Preferably, the inclined final roof-prism mirror surface comprises a transparent-medium surface, and a metallic layer contacting the transparent-medium surface. A first set of sighting reference features is disposed on the transparent-medium surface, and a second set of sighting reference features is disposed in the metallic layer. There is typically an objective lens disposed between the target and the reticle structure. Other compatible features discussed herein may be used with this embodiment.

The present approach provides a rugged, readily produced sighting device for use with barrel-type weapons and in other applications. The user of the sighting device may selectively switch between two illuminated sighting reference features, such as a first set of sighting reference features useful in close-in situations and a second set of sighting reference features useful in longer-range situations.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
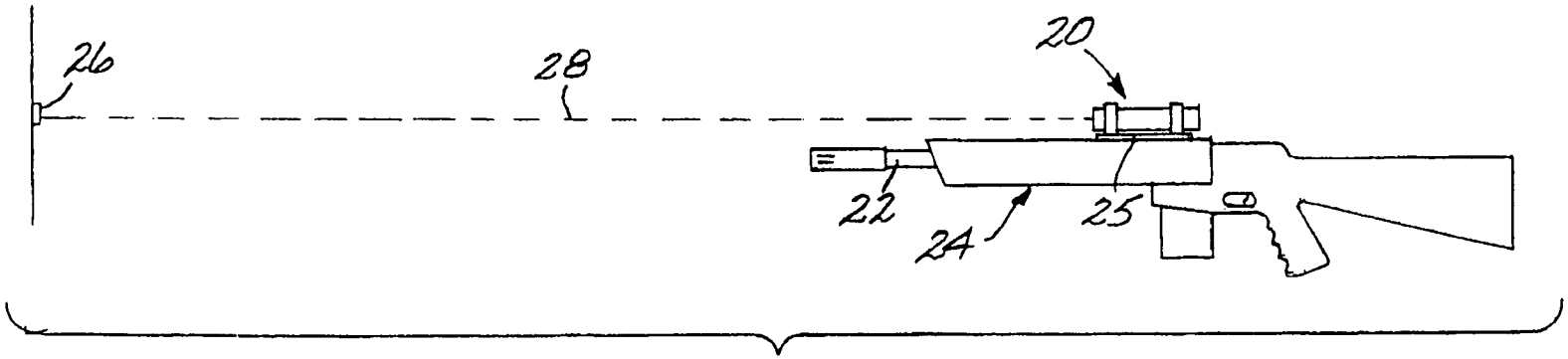
FIG. 1 is a schematic elevational view of a sighting device affixed to a rifle barrel.

FIG. 1 depicts a sighting device 20 affixed to a barrel 22 (in this case through the barrel-support) of a rifle 24 with an adjustable mount 25 that allows the sighting device 20 to be moved relative to the barrel 22. The user of the rifle 24 aims the rifle 24 and the sighting device 20 at a distant target 26 along a line of sight 28. The sighting device 20, which typically includes telescopic optics, aids the user in aiming the rifle 24 at the target 26 of interest.

Figure 2:
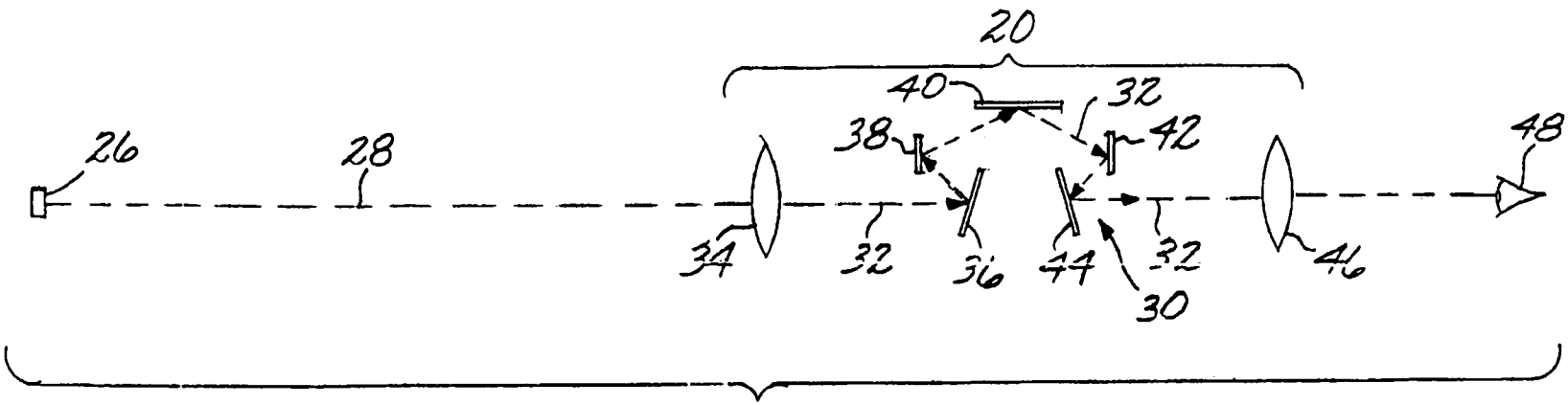
FIG. 2 is a schematic elevational detail of a first embodiment of an optical layout for the sighting device.

FIG. 2 illustrates a first embodiment of an optical layout of the sighting device 20. The sighting device 20 is affixed to the barrel 22 so that the line of sight 28 is aligned close to parallel to a bore of the barrel 22. However, the alignment is not perfect due to tolerances in the mechanical structure, changes in temperature, and the like. To achieve a more-precise alignment, the sighting device 20 is provided with a reticle structure 30. When the combination of the rifle 24 and the sighting device 20 is calibrated, a sighting reference feature of the reticle structure 30 is adjusted, typically with a fine adjustment mechanism (not shown), so that the line of sight 28 is positioned to coincide with the impact point of a projectile fired from the barrel 22.

Once the rifle 24 and the sighting device 20 are thus calibrated, the best results are achieved during service when the user of the rifle 24 aligns the sighting reference feature of the reticle structure 30 on the target 26 and then fires the rifle 24. However, and as discussed earlier, experience with other sighting systems has shown that different types of sighting reference features are preferred for different distances between the rifle 24 and the target 26. Typically, a single dot, traditionally a red dot, is preferred for shorter distances. A series of lines, usually including a cross hair, ranging lines, and windage lines, is preferred for longer distances. The present approach provides both types of sighting reference features, usable alternatively, in the single sighting device 20. Both types of sighting reference features are separately and selectively illuminated.

In the optical layout of FIG. 2, an optical path 32 from the target 26 initially coincides with the line of sight 28. The optical path 32 first passes through an objective lens structure 34, here schematically represented by a single objective lens. The objective lens structure 34 may be of any operable type, and is typically a telephoto lens that enlarges the apparent size of the image of the target 26. Suitable telephoto lens structures are known in the art for other application.

The optical path 32 enters the reticle structure 30. In one form, the reticle structure 30 comprises a set of five mirrors 36, 38, 40, 42, and 44 mounted to the housing (not shown) of the reticle structure 30. These mirrors 36, 38, 40, 42, and 44 reflect the optical path 32 away from the line of sight 28 and then back to the line of sight 28. The mirrors 36, 38, 40, 42, and 44 are preferably unpowered, flat mirrors. In the illustrated arrangement, the entry mirror 36 first encountered by the optical path 32 is inclined to the line of sight 28, the second mirror 38 is perpendicular to the line of sight 28, the third mirror 40 is parallel to the line of sight 28, the fourth mirror 42 is perpendicular to the line of sight 28, and the exit mirror 44 is inclined to the line of sight 28 by the opposite inclination of the entry mirror 36. The sighting reference features are superimposed on the optical path 32 within the reticle structure 30, preferably when the optical path 32 reflects from one or more of the mirrors 36, 38, 40, 42, and 44, by an approach to be discussed subsequently.

After the optical path 32 leaves the reticle structure 30, it passes through an eyepiece 46 that positions the eye 48 of the user in proper relation to the focal plane of the objective lens structure 34.

Figure 3:
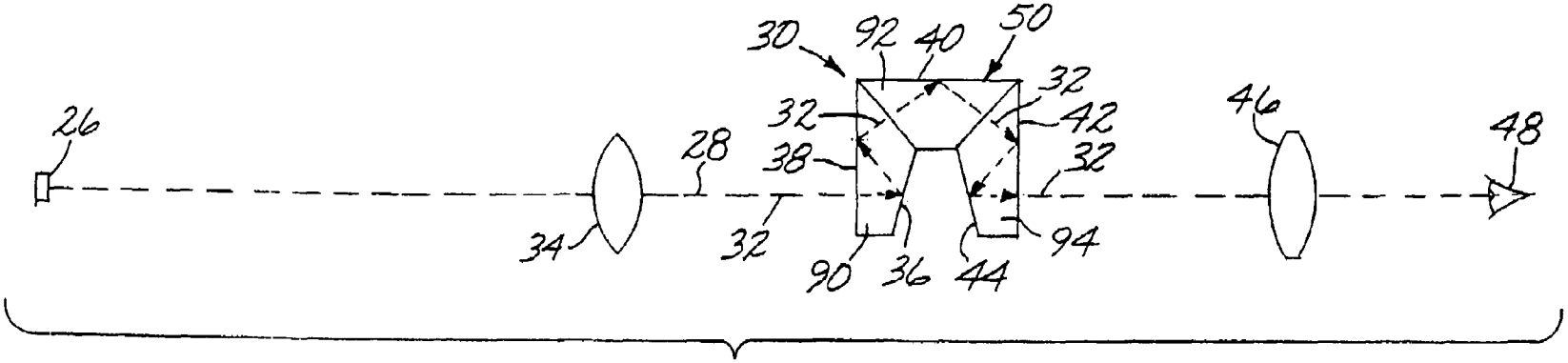
FIG. 3 is a schematic elevational detail of a second embodiment of an optical layout for the sighting device.

The fabrication, alignment, and permanent mounting of multiple separate mirrors 36, 38, 40, 42, and 44 in the embodiment of FIG. 2 may be accomplished, but with difficulty. A more-preferred approach to accomplish the functionality described above in relation to FIG. 2 is illustrated in FIG. 3, in which the reticle structure 30 comprises a roof prism assembly 50. The roof prism assembly 50 is made of a material that is transparent to the light wavelength of interest, for example glass in the case of visible light. The indicated internally reflective surfaces of the roof prism assembly 50 serve the functions of the mirrors 36, 38, 40, 42, and 44 discussed previously. When the optical path 32 is incident upon a surface of the roof prism assembly 50 that is perpendicular to the optical path 32, the optical path 32 passes through the surface of the roof prism assembly 50. When the optical path 32 is incident upon a surface of the roof prism assembly 50 that is angled to the optical path 32 at an angle greater than a critical angle, as for the surfaces that serve as the mirrors 36, 38, 40, 42, and 44, the optical path 32 is reflected from the surface of the roof prism assembly 50 in the manner illustrated for the optical path 32 in FIG. 3. The roof prism assembly 50 is conveniently fabricated by preparing three separate pieces, an entrance prism 90, a roof prism 92, and a reticle prism 94, having the illustrated configurations, and then bonding the three pieces 90, 92, and 94 together with optical cement. Other elements of FIG. 3 that are common with FIG. 2 are assigned the same reference numerals, and the prior description is incorporated.

Figure 5:
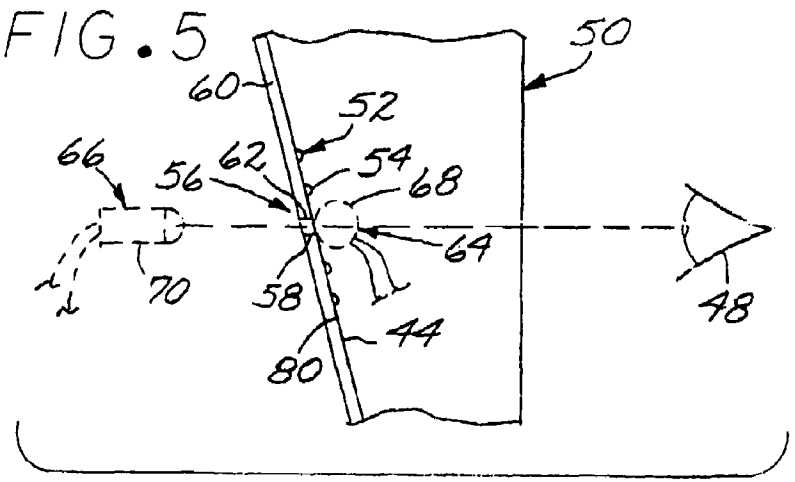
FIG. 5 is an enlarged detail of FIG. 4, taken in region 5 thereof, with the illumination sources indicated for reference.
Figure 4:
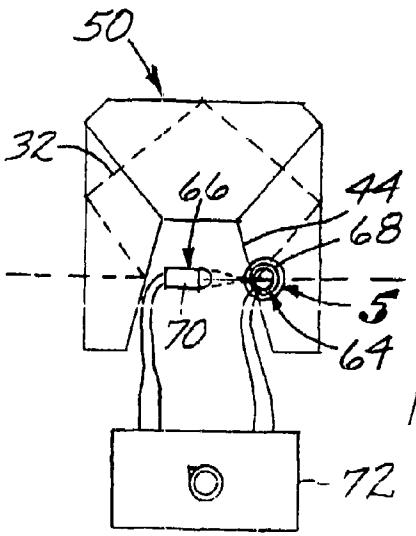
FIG. 4 is a schematic elevational detail of a first embodiment of a roof prism assembly used in the sighting device.
Figure 7:
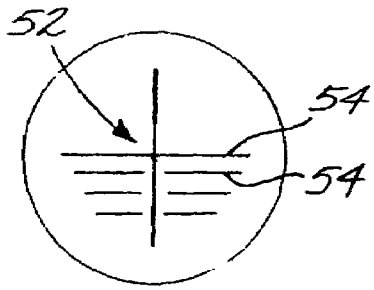
FIG. 7 is an elevational view through the sighting device when a first set of sighting features is illuminated.
Figure 8:
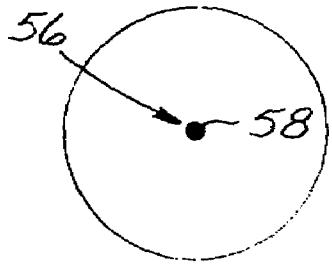
FIG. 8 is an elevational view through the sighting device when a second set of sighting features is illuminated.

FIGS. 4-5 illustrate the functioning of the sighting device 20 using the preferred roof prism assembly 50 in the reticle structure 30. The reticle structure 30 includes at least two sets of sighting reference features, in this case a first set of sighting reference features 52 comprising a set of lines 54 (seen end-on in FIG. 5), and a second set of sighting reference features 56 comprising a single dot 58. The two sets of sighting reference features 52, 56 are optically aligned and in optical registry with each other and with the line of sight 28, by virtue of their positioning in the reticle structure 30. FIG. 7 shows one form of the first set of sighting reference features 52 as seen by the user, in the form of the set of lines 54, including a cross hair and ranging lines. FIG. 8 shows one form of the second set of reference features 56 as seen by the user, in the form of the single dot 58.

The set of lines 54 is preferably formed by etching a transparent-medium surface 80 of the prism 50 at the exit mirror surface 44 to define the pattern of the set of lines 54. The etched line structure is then optionally but preferably filled with a material such as titanium dioxide to improve the uniformity of light scattering from the etched-and-filled lines. The transparent-medium surface 80 is thereafter coated with a metallic layer 60 of a material such as aluminum. A small through-opening 62 is photoetched in the metallic layer 60 in registry with the set of lines 54.

A separately operable illumination source 64, 66 is provided for each of the respective sets of sighting reference features 52, 56. Preferably, the illumination source 64 illuminates only its designated first set of sighting reference features 52, and the illumination source 66 illuminates only its designated second set of sighting reference features 56. Any operable illumination sources 64, 66 may be used. In the preferred embodiment, the first illumination source 64 is one or more light-emitting diodes 68 that controllably side light the first set of lines 54 of the first set of sighting reference features 52. (The light-emitting diode 68 is seen in end-on view in FIGS. 4 and 5.) The second illumination source 66 is a single light-emitting diode 70, preferably red in color, that controllably sends a beam of light through the opening 62 to form the single dot 58. The illumination sources 64, 66 are connected to a switch 72, which permits the illumination sources 64, 66 to be controllably and alternatively activated by the user. Activation of the illumination source 64 lights the first set of sighting reference features 52 (i.e., the set of lines 54). Activation of the illumination source 66 lights the second set of sighting reference features 56 (i.e., the single dot 58). The user may thus quickly and conveniently switch between the two sets of sighting reference features, depending upon which set of sighting reference features is most suitable to a particular situation.

Figure 6:
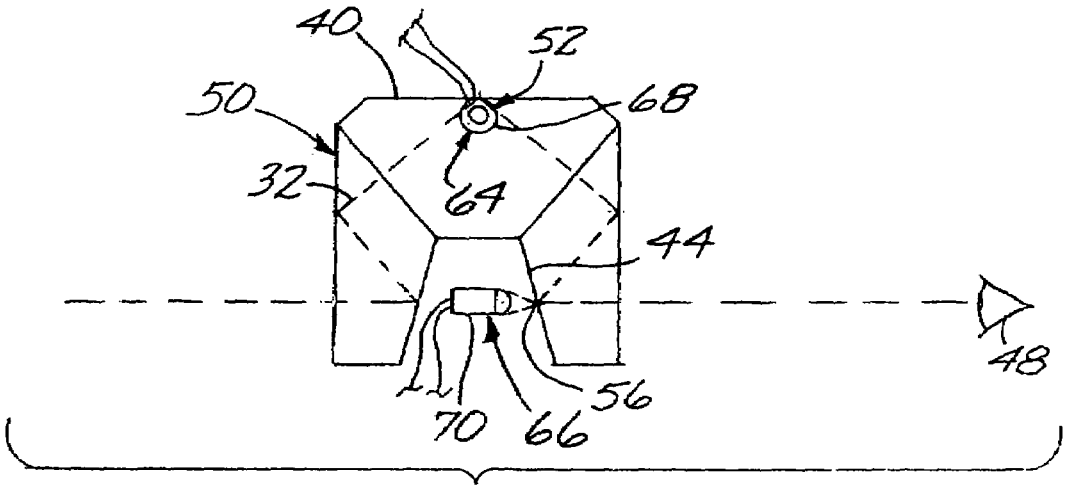
FIG. 6 is a schematic elevational detail of a second embodiment of a roof prism assembly used in the sighting device.

The embodiment of FIGS. 4-5 illustrates the placement of the first set of sighting reference features 52 and the second set of sighting reference features 56 on the same sighting-feature surface region of the reticle structure 30, in that case the exit mirror 44 from which the optical path 32 reflects just before it leaves the reticle structure 30. In another approach, illustrated in FIG. 6, the first set of sighting reference features 52 is placed at the third mirror 40 of the roof prism assembly 50, and the second set of sighting reference features 56 is placed at the exit mirror 44 of the roof prism assembly 50. That is, the two sets of sighting reference features 52, 56 are placed at different sighting-feature surface regions of the roof prism assembly 50. The respective illumination sources 64, 66 are also moved to locations corresponding to those of the two sets of sighting reference features 52, 56. The embodiment of FIG. 6 is otherwise the same as the embodiment of FIG. 4, and the prior discussion is incorporated. The approaches of the embodiments of FIGS. 4-5 and FIG. 6 may be combined to permit more than two types of sighting reference features to be provided in a single sighting device. For example, two sighting reference features could be provided at mirror 44, one or two sighting reference features could be provided at mirror 40, and so on.

Prototypes of the embodiment of FIGS. 3-5 and 7-8 has been constructed and tested, and operates as described herein.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A sighting device for aiming along a line of sight at a target comprising:

a reticle structure comprising at least two sets of sighting reference features alternately useable by selective illumination, a separately operable illumination source for each of the sets of sighting reference features, wherein each illumination source illuminates only its designated set of sighting reference features, a transparent-medium surface, wherein a first set of sighting reference features is disposed on the transparent-medium surface, and a metallic layer contacting the transparent-medium surface, wherein a second set of sighting reference features is disposed in the metallic layer.

2. The sighting device of claim 1, wherein the reticle structure comprises a sighting-feature surface region, and the sets of sighting reference features are disposed at the sighting-feature surface region.

3. The sighting device of claim 1, wherein the reticle structure comprises a sighting-feature surface region angularly inclined to the line of sight, wherein the sets of sighting reference features are disposed at the sighting-feature surface region.

4. The sighting device of claim 1, wherein the reticle structure comprises a sighting-feature surface region angularly inclined to the line of sight, wherein the sets of sighting reference features are disposed at the sighting-feature surface region, and a mirror structure that redirects an image of the target initially on the line of sight to be off the line of sight, reflects the image of the target off the sighting-feature surface region, and redirects the target image back to the line of sight.

5. The sighting device of claim 1, wherein the separately operable illumination source for each of the sets of sighting reference features comprises a first light-emitting diode for a first set of sighting reference features, and a second light-emitting diode for a second set of sighting reference features.

6. The sighting device of claim 1, wherein a first set of sighting reference features comprises a set of lines, and a second set of sighting reference features comprises a single dot.

7. The sighting device of claim 1, wherein a reticle structure comprises a roof prism assembly having an inclined roof-prism surface with a first reflective surface at an incline to the line of sight, a second reflective surface perpendicular to the line of sight, a third reflective surface parallel to the line of sight, a fourth reflective surface perpendicular to the line of sight and a fifth reflective surface at an incline to the line of sight, and wherein at least one of the sets of sighting reference features is disposed on the fifth reflective surface.

8. The sighting device of claim 1, further including an objective lens disposed between the target and the reticle structure.

9. The sighting device of claim 1, further including a switch operable to alternatively operate the illumination sources.

* * * * *